United States Patent [19]

Fani et al.

[11] Patent Number: 4,926,891

[45] Date of Patent: May 22, 1990

[54] HAIR CUTTING GUIDE

[76] Inventors: Frank P. Fani, 401 71st St., Kenosha, Wis. 53140; Frank Mikic, 3329 99th St., Kenosha, Wis. 53142

[21] Appl. No.: 403,787

[22] Filed: Sep. 5, 1989

Related U.S. Application Data

[63] Continuation of Ser. No. 165,589, Mar. 8, 1988, abandoned.

[51] Int. Cl.[5] ..... A45D 24/36

[52] U.S. Cl. ..... 132/214; 132/213

[58] Field of Search ..... 132/213, 214, 219, 126, 132/141, 142, 158, 148, 150

[56] References Cited

U.S. PATENT DOCUMENTS

| | | | |
|---|---|---|---|
| 2,305,969 | 12/1942 | Larson | 132/214 |
| 2,678,047 | 5/1954 | Garfield | 132/129 |
| 3,536,080 | 10/1970 | Player | 132/213 |
| 3,638,665 | 2/1972 | Staffas, Sr. | 132/213 |

FOREIGN PATENT DOCUMENTS 2322699 1/1977 France .

*Primary Examiner*—Robert P. Swiatek
*Assistant Examiner*—Adriene J. Lepiane
*Attorney, Agent, or Firm*—Foley & Lardner

[57] ABSTRACT

A hair cutting guide is comprised of a plurality of spaced-apart segments, each of which is formed of a pair of legs having longitudinal axes disposed along intersecting planes such that each segment is generally triangular in cross-section. The guide includes a connecting spine or the like for linking the segments along their top portion to produce a unitary structure having a predetermined height measured from the top surface between the segments along a line perpendicular to a plane defined by the distal ends of the legs in the segments.

6 Claims, 3 Drawing Sheets

HAIR CUTTING GUIDE

This is a continuation of application Ser. No. 165,589 filed Mar. 8, 1988, abandoned Sept. 5, 1989.

FIELD OF THE INVENTION

The present invention relates, in general, to devices used for cutting and grooming hair, and in particular, to cutting guides, for providing a generally uniform length hair cut. Such cuts are often referred to as "precision cuts."

BACKGROUND OF THE INVENTION

Attempts at developing mechanical hair cutting guides, as in the present invention, for providing a generally uniform length hair cut have in the past been largely unsuccessful. Such devices have heretofor been unable to function properly or adequately where the hair length desired (after the cut) was longer than one half inch. An example of such a device is described in U.S. Pat. No. 3,277,902, issued Oct. 11, 1966 to Korst.

More typically, hair stylists and barbers have relied upon nonmechanical techniques for delivering precision haircuts. One technique commonly used, for example, is referred to as the "comb-and-finger method." With this technique, the stylist lifts a section of hair away from the head with a comb, and then pinches it between two fingers. The outwardly extending segment of hair (that which extends beyond the fingers) is then cut with a scissors or the like. Obviously this technique involves a great deal of judgment on the part of the stylist (e.g., to cut the desired length of hair) and therefore greatly lends itself to the possibility of human error. Furthermore, proficiency in this technique requires a great deal of experience; mistakes in the early part of a stylist's training are inevitable.

A related technique, often referred to as the "scissors-over-comb method," similarly requires the stylist to draw a section of hair away from the subject's head with a comb. The stylist then cuts the section of hair extending beyond the outwardly directed section of the comb. As with the comb-and-finger method, a great deal of judgment is required on the part of the stylist, and, as before, this technique is particularly susceptible to error.

The present invention advantageously overcomes the problems associated with earlier mechanical devices used as hair cutting guides. Additionally, a device according to the present invention removes the need for a stylist to make judgments about the hair being cut, and, more importantly, substantially reduces the risk of error associated with the hair cutting and styling process. Indeed, utilizing a device according to the invention as described herein would permit even an unskilled user to achieve professional looking results.

SUMMARY OF THE INVENTION

A hair cutting guide, according to the invention, suitably includes a plurality of parallel spaced-apart segments having a generally triangular cross-section, each segment including a pair of legs formed along intersecting planes. The hair cutting device further includes connecting means, such as a spine or the like, for linking the segments to form a unitary structure having a predetermined height.

DETAILED DESCRIPTION OF A PREFERRED EMBODIMENT

Figure 1:
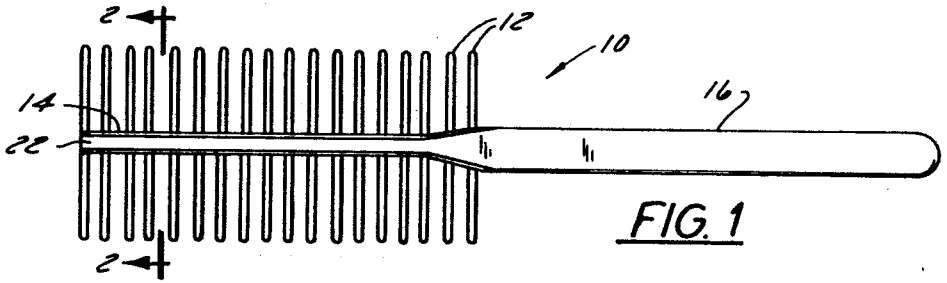
FIG. 1 is a top plan view of an exemplary hair cutting guide according to the present invention.
Figure 3:
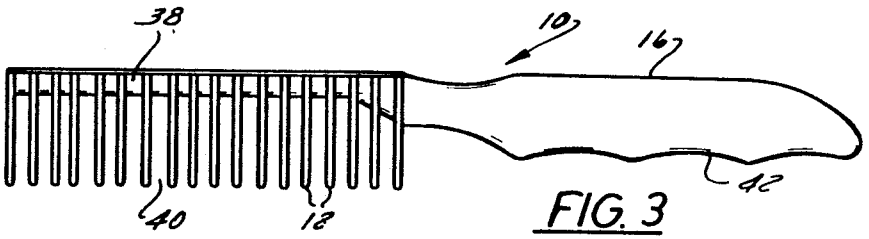
FIG. 3 is a side elevation view of a hair cutting guide according to the invention.

Referring to FIG. 1, a hair cutting guide 10, according to the invention, is comprised of a plurality of parallel, spaced-apart segments 12, attached to a centrally disposed spine 14 extending in a direction substantially perpendicular to segments 12 and a handle 16, disposed at one end of spine 14.

Figure 2A:
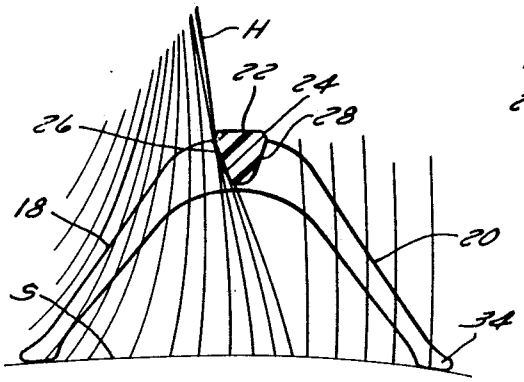
FIG. 2*a* is a cross sectional view showing how the hair cutting guide is used.
Figure 2:
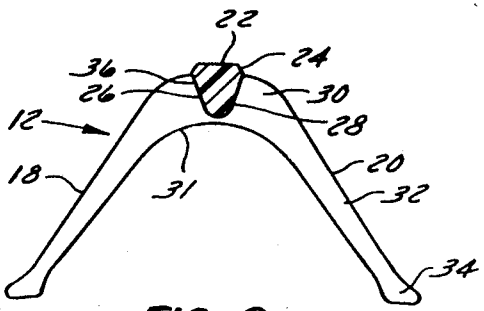
FIG. 2 is an enlarged cross-sectional view of a segment employed in the hair cutting guide taken along line 2—2 of FIG. 1.

Referring to FIG. 2, each segment 12 is comprised of a pair of angled legs 18,20, the longitudinal axes of which are disposed substantially in intersecting planes, the combination yielding a structure having a generally triangular shape in cross-section. Legs 18,20 may be joined along a lower section thereof, as shown in FIG. 2, or they may be completely separate, the choice of which is dependent to some extent upon the selected manufacturing process. The angle formed by the intersecting planes in which the longitudinal axes of legs 18,20 lie is in the range of 45° and 60°, and more preferably approximately 54°, although it will be recognized that the specific angle chosen will be dictated to some extent by the length of each leg 18,20, as will become apparent.

Spine 14 suitably includes a generally horizontal top wall 22, having an approximately 0.03 inch beveled edge 24 on each side thereof and opposed converging side walls 26,28, which provides a generally triangular shape in cross-section. In the preferred embodiment illustrated, spine 14 has a width of about 0.20 inches, measured from the lowermost portion of bevel 24 of straight top wall 22 on each side, and a height of about 0.25 inches. Legs 18,20 each include a gently sloped shoulder 30, a generally tapered body 32 and a foot 34. Shoulders 30 each include an angled face 36, dimensioned to mate with side walls 26,28 of spine 14 below beveled edges 24. When spine 14 is inserted between legs 18,20, beveled top wall 22 extends upwardly beyond the topmost portion of legs 18,20, as shown in FIG. 2.

Legs 18,20 are suitably dimensioned such that the distance between the outward ends of each foot 34 is approximately 1.8 inches and the overall height of cutting guide 10, which is defined as the height measured from the the median of top wall 22 along a line perpendicular to a horizontal plane intersecting the lowermost portion of feet 34, is approximately 1.5 inches. Each foot 34 has a lengthwise dimension of approximately 0.12 inches, and is preferably angled with respect to the horizontal plane between each foot 34, rising from the outermost portion of foot 34 approximately 5°.

Figure 4:
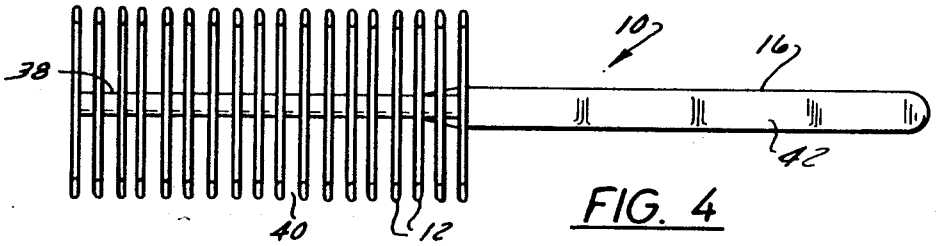
FIG. 4 is a bottom plan view of the hair cutting guide of FIG. 1.

As stated above, cutting guide 10 includes a plurality of parallel segments 12, connected to spine 14. Each of the adjacent segments 12 defines therebetween a groove 38, preferably about 0.125 inches wide, along each opposing side wall 28 of spine 14. Grooves 38, as illustrated, follow the convergence of side wall 28 and smoothly merge a series of parallel channels 40 through which hair may be directed, as will be explained hereinbelow. The longitudinal axes of legs 18,20 of each of segments 12 are essentially coplaner with corresponding legs 18,20 of all other segments 12. As a result of this configuration, legs 18,20 appear to form a pair of intersecting rows of teeth, as best illustrated in FIGS. 1 and 4. The number of segments comprising hair cutting guide 10 may, of course, vary, but it is preferred that the overall length of the segmented portion of hair cutting guide 10 be approximately 3.5 inches.

Handle 16 may be integral with or removably attached, as desired, to one end of spine 14, and includes a series of downwardly extending grip projections 42 which permit a user to firmly grasp hair cutting guide 10. The length of handle 16 is preferably approximately 4.0 inches, although this may, of course, be varied without departing from the spirit of the invention.

The use of hair cutting guide 10 is relatively straightforward; in fact, ease of use is one of its principle advantages. Owing in large part to its design, even a nonprofessional may achieve professional-looking results with little or no experience. The user begins by inserting cutting guide 10 into the hair H to be cut at a lower portion of the subject's heads. As cutting guide 10 is then drawn through the hair toward the top of the subject's head as seen in FIG. 2A, the hair moves between adjacent legs 18,20 through channels 40 and into grooves 38, contacting side walls 26,28 of spine 14. The hair is then lifted as guide 10 continues, coming to rest against beveled edge 24 of top wall 22 with the excess hair extending beyond wall 22. The user then cuts the hair by simply running a scissors, razor or the like along top wall 22, in either direction along its longitudinal axis. As the hair is cut, the uncut portion slips under spine 14 where it receives no further consideration during the cutting operation. The user continues to run cutting guide 10 through generally parallel paths along the subject's head until all of the hair has been cut in the manner described.

Another advantage of cutting guide 10 relates to the fact it automatically shapes the hair as it is being cut. For example, persons having generally flat heads typically prefer the hair growing around the angled portion of the head (the point where the shape of the head changes from being substantially horizontal; i.e., the top of the head, to being substantially vertical) to be cut shorter than the rest of the hair. Cutting the hair in this fashion deemphasizes the cube-like shape of the head, and produces a softer, more pleasing slightly rounded shape. As cutting guide 10 is drawn up the side of the subject's head, it encounters the angled portion of the head. As it is drawn over the angled portion of the head, the length of the hair being cut is reduced. This is due to the fact that the shape of the head forces the hair under guide 10 to pierce the imaginary plane between legs 18,20 of each segment 12 much more so than when the shape of the head under guide 10 is substantially horizontal or vertical. Thus, the distance between the point on the head being cut and top wall 22 has been reduced; the hair at that point is therefore cut shorter.

Cutting guide 10 also permits the user to cut around protrusions, such as ears, with far less difficulty. For example, where the user desires to cut around the subject's ear, guide 10 may be inserted over the ear so that it extends into the region between legs 18,20 of segments 12. The ear may then be easily pulled away from the side of the subject's head while the hair around the ear is trimmed; this additionally minimizes the accidental cutting of the subject's ear.

Varying the angle between the planes in which legs 18,20 lie and/or the length of either/both of legs 18,20 can be used to change the height of cutting guide 10 from the uppermost point of top wall 22 (i.e., the cutting surface) along a line perpendicular to an imaginary plane defined by any two of the parallel segments 12, or other characteristics of cutting guide 10 (i.e., the span of legs 18,20). Thus, a number of variations on the basic design are possible. FIGS. 5A through 8C are illustrative.

Figure 5A:
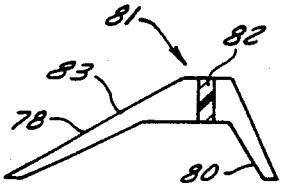
FIGS. 5A through 8C are alternative embodiments of hair cutting guides according to the invention.
Figure 5B:
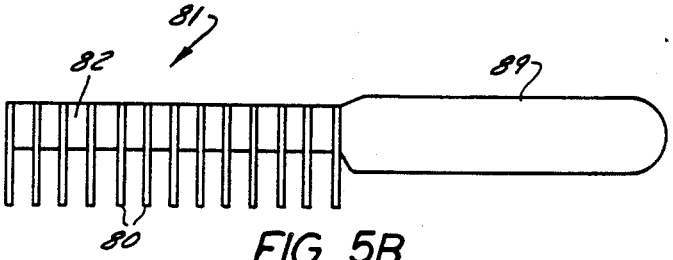

FIGS. 5A and 5B illustrate an alternative form of a hair cutting guide according to the invention, generally indicated as 81. Cutting guide 81 is comprised of a plurality of spaced-apart segments 83 having legs 78,80 of different lengths, a spine 82, and a handle 85. This configuration is particularly advantageous for blending hair being cut when it is desired that certain portions of hair be of different lengths. For example, it is common for stylists and barbers to cut hair shorter along the subject's neck and above the ears. The length of hair which would remain after cutting guide 81 is initially inserted into the lower portion of a subject's hair would, as before, be defined by the height of guide 81, measured from the top of spine 82 to an imaginary plane joining the lowermost portions of legs 78,80. As leg 80 is drawn upwardly towards the top of the subject's head, it may be gradually lifted away from the scalp so that only leg 78 remains in direct contact with the scalp. As this occurs, the length of the hair remaining becomes increasingly longer, to a maximum length equal to the height of leg 78, measured from the lowermost portion of leg 78 to the uppermost portion where it joins spine 82.

Figure 6A:
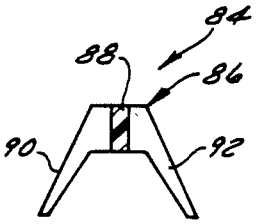
Figure 6B:
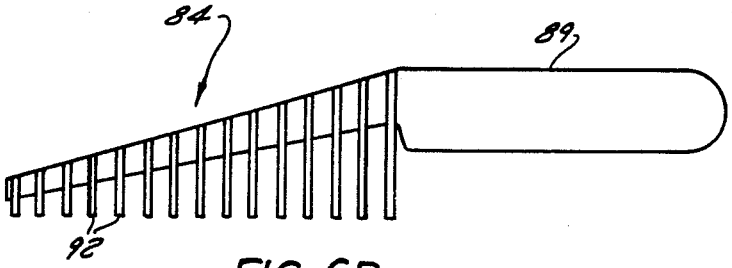
Figure 7A:
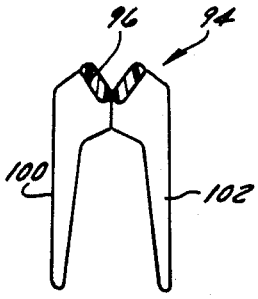
Figure 7B:
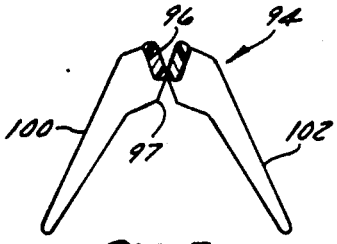
Figure 7B:
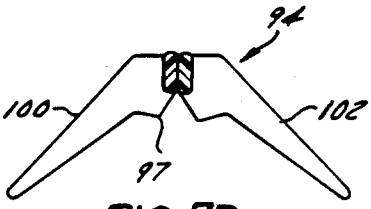
Figure 7D:
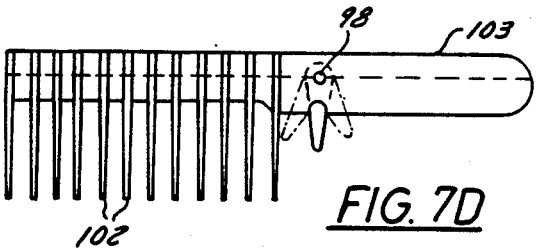

FIGS. 6A and 6B illustrate an alternative embodiment of a cutting guide according to the invention, generally indicated as 84. Cutting guide 84 comprises a plurality of spaced-apart segments 86 having a pair of legs 90,92, a spine 88 and a handle 89, wherein the height of segments 86, measured from the top of spine 88 to a point below and perpendicular thereto lying on an imaginary plane between legs 90,92, varies. Cutting guide 84 advantageously permits the user to mechanically blend hair where it is desired to have hair of varying lengths, such as, for example, at the neckline or above the ears. For example, to cut the hair above the ears, guide 84 would be inserted into the subject's hair at the front of the side portion of the subject's head (e.g., above an ear) and drawn towards the rear of the head so that the shortest legged segments remained closest to the ear. In this manner, hair directly above the ear would be the shortest, gradually increasing in length as the height of the segments increases upwardly on guide 84.

FIGS. 7A through 7D illustrate an alternative embodiment of a hair cutting guide according to the invention, generally indicated as 94. Hair cutting guide 94 comprises a plurality of spaced-apart segments having legs 100,102 attached to a spine 96 having a hinge 97, and a handle 103. Any suitable method for causing spine 96 to flex about hinge 97, such as, for example, mechanism 98 may be employed to permit the user to vary the angle between the intersecting planes in which legs 100,102 lie. In this manner, the height of guide 94, measured from the top of spine 96 to a point perpendicular thereto lying on an imaginary plane between the lowermost points of legs 100,102, can be varied. This permits the user to deliver hair cuts of varying length.

Figure 8B:
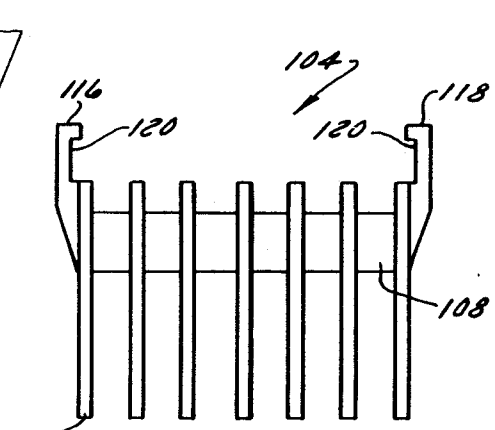
Figure 8A:
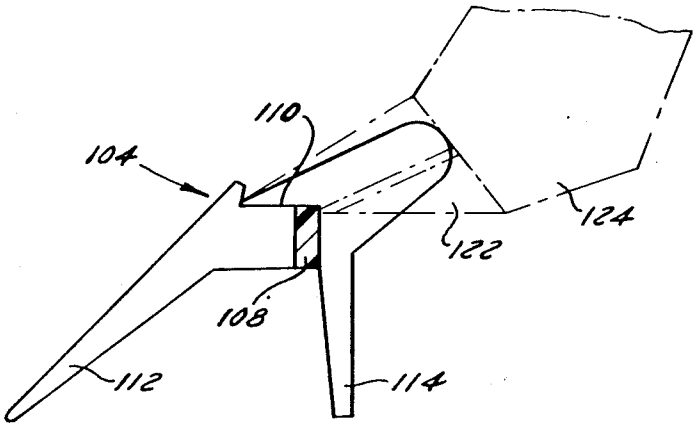
Figure 8C:
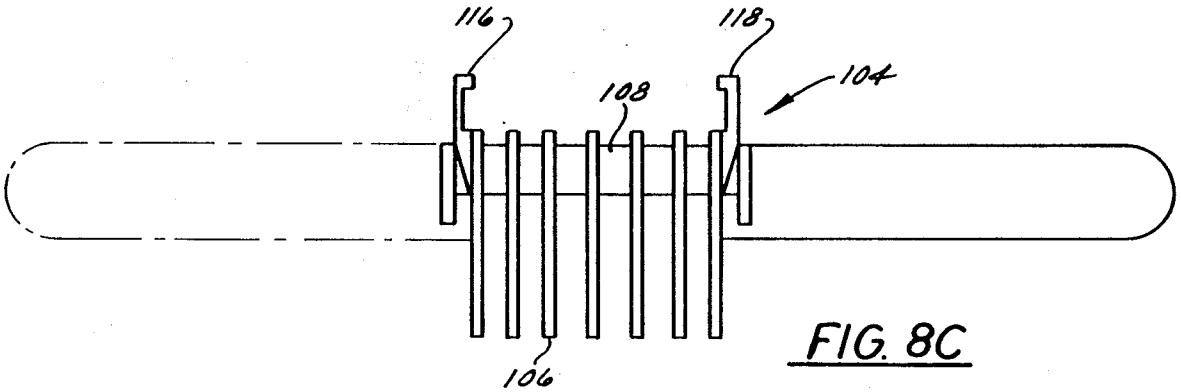

FIGS. 8A, 8B and 8C illustrate alternative embodiment of a hair cutting guide according to the invention, generally indicated as 104. Hair cutting guide 104 comprises a plurality of spaced-apart segments 106, having legs 112,114, connected to a spine 108. A ledge 110 is formed along the uppermost portion of spine 108, extending through a portion of leg 112, along a top portion thereof. Opposed, parallel, spaced-apart clips 116,118, extending upwardly from the endmost portions of spine 108, include a small C-shaped groove 120, configured for mating engagement with a base 122 of a mechanical clippers 124, shown in phantom lines in FIG. 8A. In operation, leg 112 of guide 104 would be inserted into the subject's hair at a lower portion thereof (e.g., at the neckline) and drawn through the subject's hair towards the top of the subject's head. As the hair is drawn through guide 104, in a manner similar to that described hereinabove with respect to guide 10, it would be cut by clippers 124. Leg 114 of guide 104 may extend angularly from spine 108, as in the embodiments illustrated above, or may be substantially vertical, as shown in FIG. 8A. This is due to the fact that since clipper 124 is only capable of cutting hair in a single direction, the primary function of leg 114 is to provide for the proper height of guide 104, as measured from the topmost portion of spine 108 to a point perpendicular thereto lying in an imaginary plane between the lowermost portions of legs 112,114.

Any suitable method of manufacture may be employed in the construction of hair cutting guide 10. By way of non-limiting example, legs 18,20 may be formed as a unitary structure (i.e., joined at the base thereof as described hereinabove) by injection molding techniques and then connected to the combination spine 14/handle 16 by use of a thermoweld or the like. Alternatively, the entirety of hair cutting guide 10 may be formed as a unitary structure by use of injection molding techniques. Applicants have found the latter method to be the most economical. Where injection molding techniques are used, hair cutting guide 10 may be constructed from any suitable material, such as, for example, ABS or acetal. Die casting methods may be used, employing materials such as, for example, aluminum or zinc.

While the invention has now been described with reference to certain preferred embodiments, those skilled in the art will appreciate the various substitutions, modifications, changes and omissions which may be made without departing from the spirit thereof. Accordingly, it is intended that the scope of the present invention not be limited by the foregoing description, but be measured with regard to the claims granted herein.

What is claimed:

1. A hair cutting guide comprising:

a plurality of parallel spaced-apart segments, each of said segments comprising a pair of legs having longitudinal axes formed along intersecting planes such that each of said segments has a generally triangular shape in cross-section; and connecting means being of generally triangular shape in cross-section including a top surface having a longitudinal axis, for linking said segments along a top portion thereof to produce a generally unitary structure having a predetermined height, said height measured from said top surface between said segments along a line perpendicular to a plane defined by distal ends of a pair of said legs in said segments, said top surface having means for defining a cutting plane lying generally parallel to the plane defined by distal ends of said legs; and said connecting means further having a pair of side walls associated with said top surface and each defining along the longitudinal axis a surface of a groove between pairs of legs in adjacent segments whereby hair is captured in said grooves against said side walls and is cut along the longitudinal axis of said top surface in the plane defined by said top surface.

2. The hair cutting guide of claim 1, wherein said legs of said segments further include a foot portion disposed on said legs at a point furthest from said connecting means.

3. The hair cutting guide of claim 1, wherein at least one of said legs of each of said pairs of legs comprises a shoulder portion disposed proximate said connecting means and a tapered end portion, disposed proximate said shoulder portion.

4. The hair cutting guide of claim 1, in which a beveled wall connects said top surface to said side walls.

5. The hair cutting guide of claim 1, wherein said intersecting planes corresponding to said legs of each of said pairs of legs form an angle in the range of 45° and 60° therebetween.

6. The hair cutting guide of claim 1, additionally comprising connecting means for attaching said guide to suitable cutting means associated therewith.

* * * * *